US008517473B2

(12) United States Patent
Monyak et al.

(10) Patent No.: US 8,517,473 B2
(45) Date of Patent: Aug. 27, 2013

(54) ROAD GRADING PICK WITH WASHER

(75) Inventors: Kenneth Monyak, Abingdon, VA (US); Joseph Fader, Abingdon, VA (US); Lars-Åke Carlsson, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 261 days.

(21) Appl. No.: 12/988,706

(22) PCT Filed: May 4, 2009

(86) PCT No.: PCT/SE2009/050478

§ 371 (c)(1), (2), (4) Date: Jan. 14, 2011

(87) PCT Pub. No.: WO2009/142578

PCT Pub. Date: Nov. 26, 2009

(65) Prior Publication Data

US 2011/0109148 A1 May 12, 2011

Related U.S. Application Data

(60) Provisional application No. 61/054,175, filed on May 19, 2008.

(51) Int. Cl.
*E21C 35/197* (2006.01)

(52) U.S. Cl.
USPC ..... 299/104; 299/36.1; 299/107

(58) Field of Classification Search
USPC ..... 299/36.1, 37.1, 104, 106, 107, 110; 404/75
See application file for complete search history.

(56) References Cited

U.S. PATENT DOCUMENTS

| | | | | |
|---|---|---|---|---|
| 4,784,517 | A | 11/1988 | Bergqvist et al. | |
| 4,818,027 | A * | 4/1989 | Simon | 299/107 |
| 5,054,217 | A | 10/1991 | Nilsson et al. | |
| 6,113,195 | A | 9/2000 | Mercier et al. | |
| 6,508,516 | B1 * | 1/2003 | Kammerer | 299/104 |

(Continued)

FOREIGN PATENT DOCUMENTS

| | | |
|---|---|---|
| DE | 10110015 | * 10/2002 |
| WO | 00/68512 | 11/2000 |

OTHER PUBLICATIONS

Notification of the First Office Action against 200980117015.3, dated Nov. 24, 2011.

*Primary Examiner* — David J. Bagnell
*Assistant Examiner* — Michael Goodwin
(74) *Attorney, Agent, or Firm* — Morgan, Lewis & Bockius LLP

(57) ABSTRACT

A road grading pick includes a cutting head, a shank, a shoulder at a transition between the cutting head and the shank, and a polygonal-shaped washer or an oval-shaped washer. The shank is positioned in an opening of the washer to position the washer along a longitudinal length of the shank between a rearward end of the shank and the rearward facing surface of the shoulder. In a preinstalled position, the washer compresses a friction retainer on the shank of the road grading pick to facilitate seating of the road grading pick in a blade of a road grading apparatus. In an installed position on an adapter board for a moldboard of road grading equipment, the friction retainer is no longer in the opening of the washer and the washer prevents washer rotation and shields an underlying mounting surface while allowing rotation of the road grading pick.

13 Claims, 7 Drawing Sheets

(56) References Cited

U.S. PATENT DOCUMENTS

| | | | | |
|---|---|---|---|---|
| 6,799,388 | B2 * | 10/2004 | Weaver et al. | 37/448 |
| 7,195,321 | B1 * | 3/2007 | Sollami | 299/104 |
| 2002/0092210 | A1 * | 7/2002 | Sollami | 37/452 |
| 2003/0230927 | A1 | 12/2003 | Latham | |
| 2004/0004389 | A1 * | 1/2004 | Latham | 299/104 |
| 2008/0036272 | A1 * | 2/2008 | Hall et al. | 299/104 |
| 2008/0036274 | A1 | 2/2008 | Hall et al. | |

* cited by examiner

ROAD GRADING PICK WITH WASHER

CROSS REFERENCE TO RELATED APPLICATIONS

This application is the National Stage of International Application No. PCT/SE2009/050478, filed May 4, 2009, and claims benefit of U.S. Application No. 61/054,175, filed May 19, 2008.

FIELD

The present disclosure relates to a tool for road grading apparatus. More specifically, the present disclosure relates to a road grading pick including a washer. The road grading pick can be mounted on an adapter board for a moldboard of the road grading apparatus. The disclosure relates to the tool per se, as well as to the adapter board and to the road grading apparatus with the adapter board.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

On road grading systems, picks rotate during operation. The rotation of the pick causes frictional wear between the pick shoulder and the pick mounting face of the board. Abrasive fines from the grading process migrate between the pick shoulder and the face of the board. These fines accelerate the wear.

Washers are not commonly used on picks in road grading systems. However, in the road milling industry washers are typically used to enhance pick rotation and protect the mounting face of the pick holders. Since washer rotation is not inhibited, wear on the pick holder face is still a problem.

Another issue with existing grading systems is wear between picks on the mounting face of the board. The picks wear during the grading operation, but the exposed parts of the mounting face between them wear as well.

Typical frictional retainers commonly used on road grading picks are stiff and very difficult to compress. This makes pick installation difficult and time consuming.

SUMMARY

The disclosed road grading pick includes a polygonal-shaped washer or an oval-shaped washer. In a preinstalled position, the washer compresses a friction retainer on the shank of the road grading pick to facilitate seating of the road grading pick in a blade of a road grading apparatus. In an installed position on the adapter board for the moldboard of road grading equipment, the washer prevents washer rotation and shields an underlying mounting surface while allowing rotation of the road grading pick.

An exemplary embodiment of a road grading pick comprises a cutting head with a cutting tip at a front end, a shank at a rear end, a shoulder at a transition between the cutting head and the shank, the shoulder including a rearward facing surface, and a washer including an opening in a body, wherein the shank is positioned in the opening of the washer to position the washer along a longitudinal length of the shank between a rearward end of the shank and the rearward facing surface of the shoulder, and wherein the washer is polygonal-shaped or oval-shaped.

An exemplary embodiment of an adapter board for a moldboard of a piece of road grading equipment comprises an elongated planar housing including a first edge for mounting to the moldboard, and a plurality of road grading picks mounted on a second edge of the housing, the second edge opposing the first edge, wherein the plurality of road grading picks include a cutting head with a cutting tip at a front end, a shank at a rear end, a shoulder at a transition between the cutting head and the shank, the shoulder including a rearward-facing surface, a friction retainer positioned about at least a portion of the shank, and a washer including an opening in a body extending from a first surface to a second surface, wherein the plurality of road grading picks are rotatably mounted in a bore in the second edge by the friction retainer, wherein the shank is positioned in the opening of the washer with the first surface of the washer contacting the rearward-facing surface of the shoulder and the second surface of the washer contacting the second edge of the adapter board, and wherein edges of washers of adjacent road grading picks contact each other.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
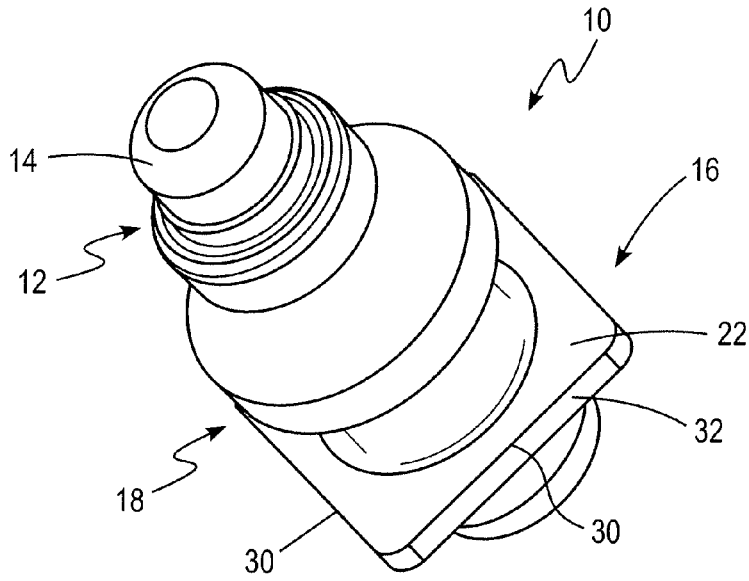
FIG. 1 is a perspective view of an exemplary embodiment of a road grading pick with a square-shaped washer.
Figure 2:
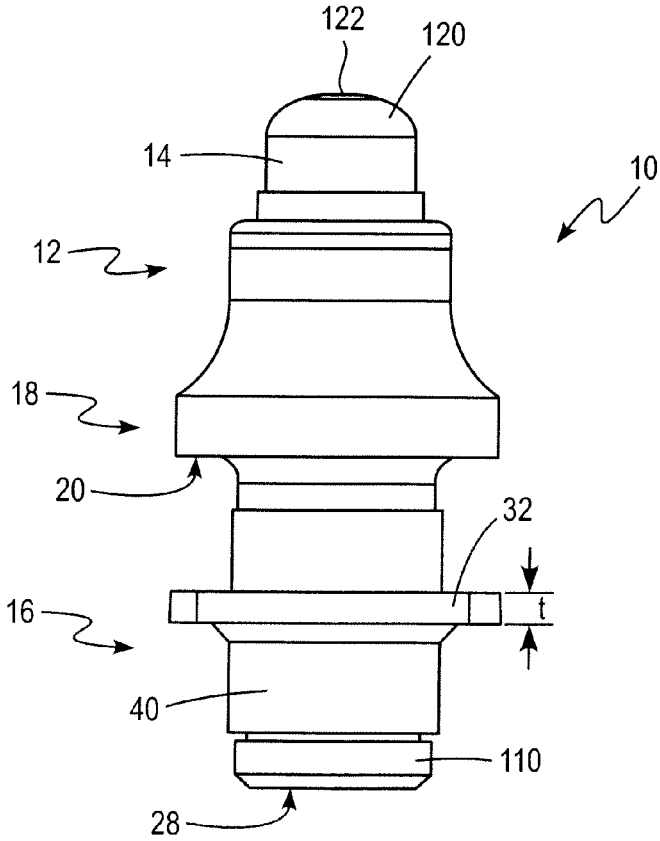
FIG. 2 is a side view of the exemplary embodiment of the road grading pick shown in FIG. 1.

FIG. 1 is a perspective view of an exemplary embodiment of a road grading pick with a square-shaped washer. FIG. 2 is a side view of the exemplary embodiment of the road grading pick shown in FIG. 1. In the shown exemplary embodiment, the road grading pick 10 includes a cutting head 12 with a cutting tip 14 at a front end and a shank 16 at a rear end. A shoulder 18 is located at a transition between the cutting head 12 and the shank 16 and includes a rearward facing surface 20. A washer 22 with an opening 24 in a body 26 has a shank 16 positioned therein. The shank 16 is positioned in the opening 24 of the washer 22 to position the washer 22 along a longitudinal length of the shank 16 between a rearward end 28 of the shank 16 and the rearward facing surface 20 of the shoulder 18.

In exemplary embodiments, the washer is polygonal-shaped. FIGS. 1-4 show various exemplary embodiments of a road grading pick with a polygonal-shaped washer. A polygonal-shaped washer is a washer that, in plan view such as in FIGS. 7A, 8 and 9, has an outer boundary composed of edges 30 that meet at vertices. The vertices can be sharp or can be rounded. The connected edges form a closed path that is in the shape of a polygon. Depending on the shape of the polygon as regular or non-regular, the polygonal-shaped washer can be circumscribed by a circle of radius or by an ellipse with a semimajor axis and a semiminor axis. Examples of polygonal shapes include a triangle, a rectangle, a pentagon, etc. . . . , and can have straight sides or sides that are convex or concave or a combination thereof. For example, a Reuleaux polygon, except for a circle, is an example of a polygonal-shaped washer with non-straight sides suitable for use as a washer in a road grading pick. FIG. 9 shows an example of such a washer 22 having a shape of a Reuleaux polygon.

Figure 3:
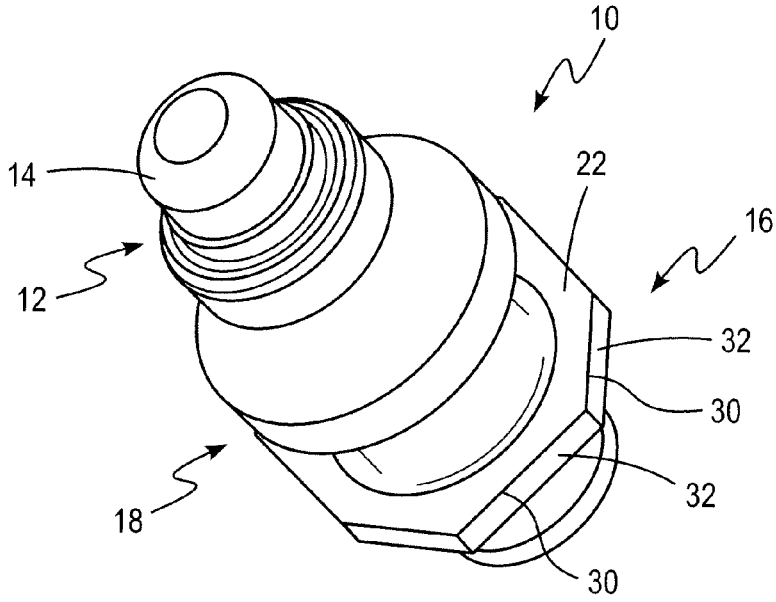
FIG. 3 is a perspective view of an exemplary embodiment of a road grading pick with an octagonal-shaped washer.
Figure 4:
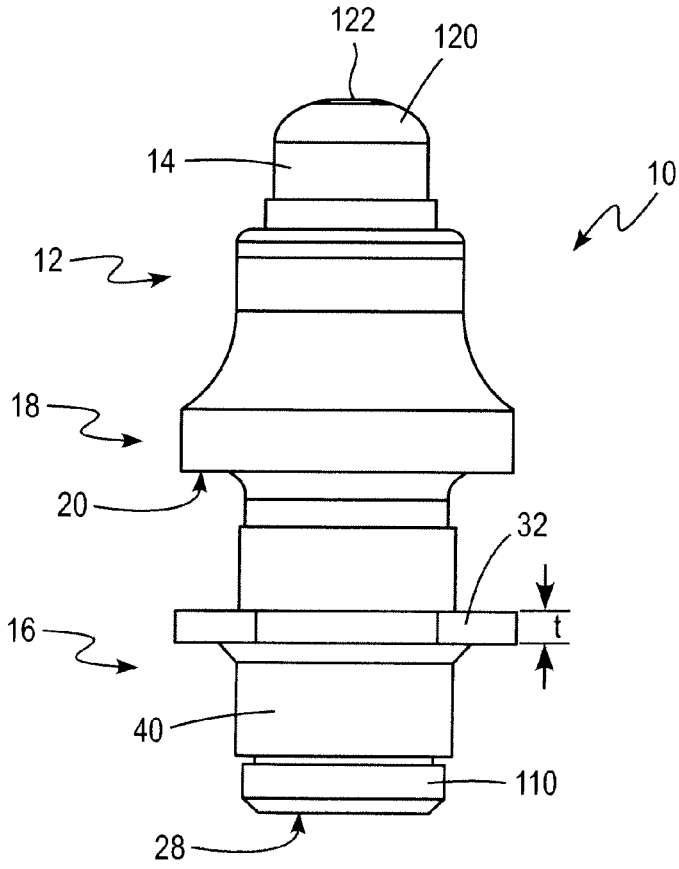
FIG. 4 is a side view of the exemplary embodiment of the road grading pick shown in FIG. 3.

In an exemplary embodiment, the polygonal-shaped washer 22 can have an even number of edges. Alternatively, the polygonal-shaped washer can have an odd number of edges. FIG. 3 is a perspective view of an exemplary embodiment of a road grading pick with an octagonal-shaped washer. FIG. 4 is a side view of the exemplary embodiment of the road grading pick shown in FIG. 3. The exemplary embodiment of a road grading pick shown in FIGS. 3 and 4 have similar features as the exemplary embodiment shown in FIGS. 1 and 2, with such similar features bearing the same reference numerals. However, and as is observable in the figures, while the washers in the respective figures are all polygonal-shaped, the washer 22 in FIGS. 3 and 4 is octagonal-shaped while the washer 22 in FIGS. 1 and 2 is square-shaped.

Figure 5:
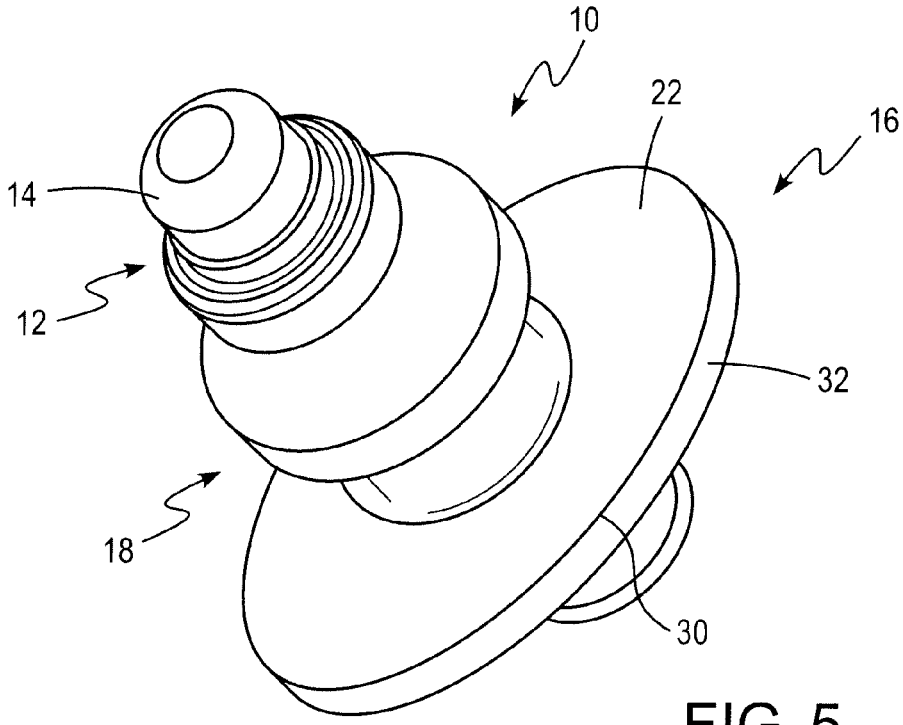
FIG. 5 is a perspective view of an exemplary embodiment of a road grading pick with an oval-shaped washer.
Figure 6:
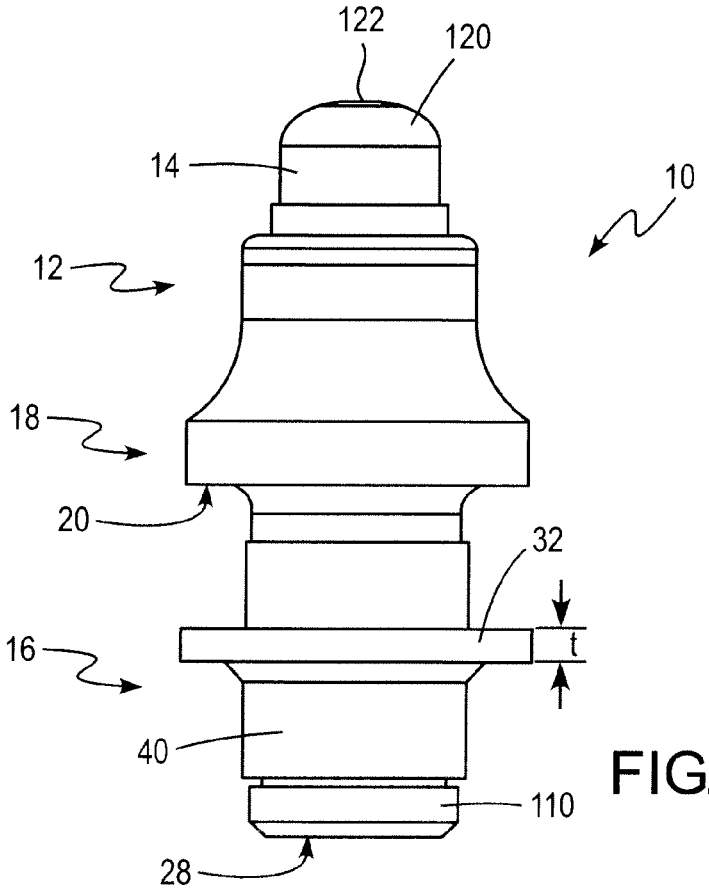
FIG. 6 is a side view of the exemplary embodiment of the road grading pick shown in FIG. 5

In another exemplary embodiment, the washer is oval shaped. FIGS. 5-6 show an embodiment of a road-grading pick with an oval-shaped washer 22. An oval-shaped washer is a washer that, in plan view, has an outer boundary that is an oval or which herein is defined as any ellipse-like, convex, closed, plane curve that is differentiable, not self-intersecting, and has at least one axis of symmetry. An ellipse shape (FIG. 10) and an egg shape (FIG. 11) are both examples of an oval-shape. The exemplary embodiment of a road grading pick shown in FIGS. 5 and 6 have similar features as the exemplary embodiment shown in FIGS. 1 to 4, with such similar features bearing the same reference numerals.

Edges 30 of the washer 22 have a thickness (t) that defines a face 32. The face 32 itself in the polygonal-shaped washer can also be polygonal-shaped. The polygonal shape of the face 32 can be any suitable shape, including by way of example that of a quadrilateral, such as a rectangle or a trapezoid.

Figure 7A:
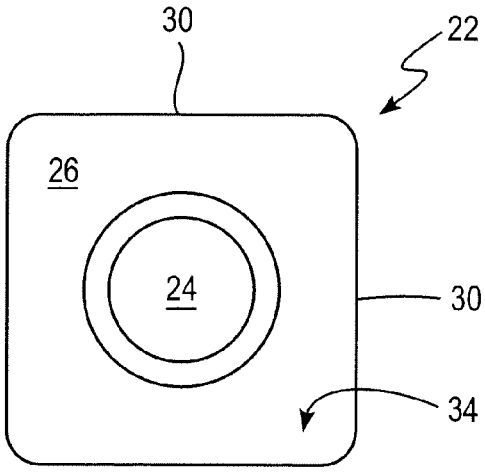
FIG. 7A is a plan view of an exemplary embodiment of a washer having a square shape.
Figure 7B:
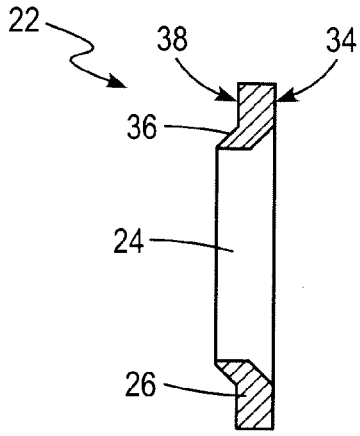
FIG. 7B is cross-sectional side view of the exemplary embodiment of a washer shown in FIG. 7A.
Figure 13:
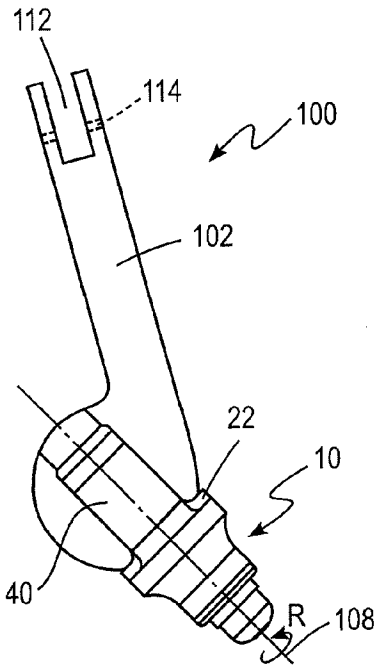
FIG. 13 is a cross-sectional view of an adapter board for a moldboard of a piece of road grading equipment showing an installed road grading pick.

FIGS. 7A and 7B show a plan view and a cross-sectional side view, respectively, of an exemplary embodiment of a washer having a square shape. The illustrated views show the opening 24 in the washer 22 as seen from the first surface 34. In exemplary embodiments of the washer 22, the opening 24 is chamfered or countersunk from the first surface 34 and includes an extruded cone 36 projecting from a plane of the second surface 38. The extruded cone 36 mates in the bore of an adapter board 100 (as seen in FIG. 13). The extruded cone 36 provides support and stability to the installed road grading pick 10. The washer design can be flat or Bellville-shaped as disclosed in U.S. Pat. No. 6,113,195, the entire contents of which are incorporated herein by reference.

Figure 8:
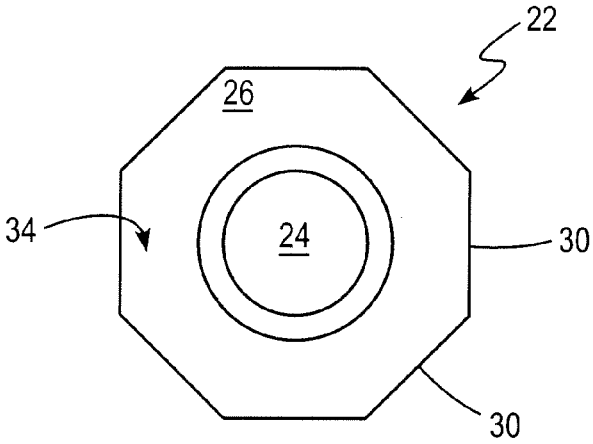
FIG. 8 is plan view of another exemplary embodiment of a washer having an octagonal shape.
Figure 9:
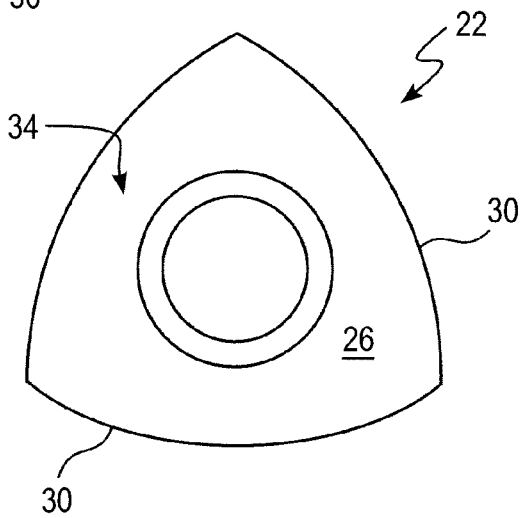
FIG. 9 is plan view of another exemplary embodiment of a washer having a shape of a Reuleaux polygon.
Figure 10:
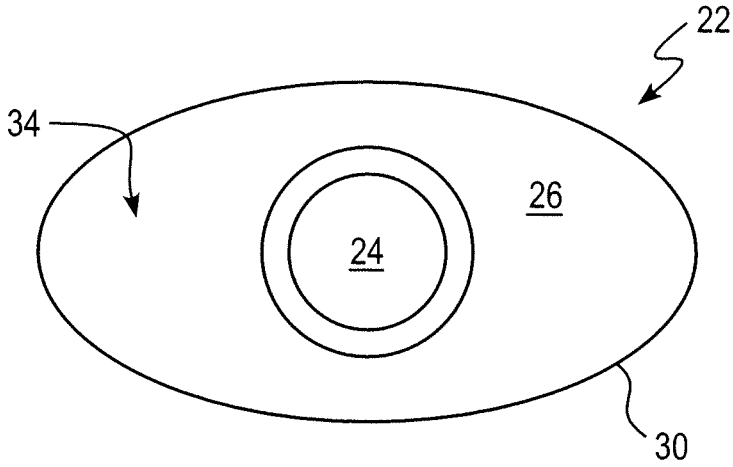
FIG. 10 is plan view of another exemplary embodiment of a washer having a first oval shape.
Figure 11:
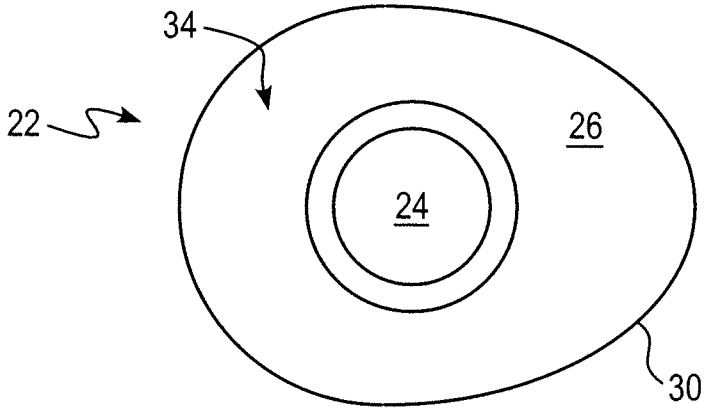
FIG. 11 is plan view of another exemplary embodiment of a washer having a second oval shape.

FIG. 8 shows a plan view of an exemplary embodiment of a washer having an octagonal shape. FIG. 9 is plan view of another exemplary embodiment of a washer having a shape of a Reuleaux polygon. FIG. 10 is plan view of another exemplary embodiment of a washer having a first oval shape, in this case the shape of an ellipse. FIG. 11 is plan view of another exemplary embodiment of a washer having a second oval shape, in this case the shape of an egg. Although cross-sections of the washers having an octagonal shape or an oval shape are not included here, the features of the opening 24, including the chamfer or countersink from the first surface 34 and an extruded cone 36 projecting from a plane of the second surface 38, are similar for the octagon-shaped washer (or any polygonal-shaped washer or oval-shaped washer) as those shown and described for the square-shaped washer.

Exemplary embodiments of the road grading pick 10 comprise a friction retainer 40. Pre-installation in an adapter board 100, the friction retainer 40 is positioned about at least a portion of the shank 16. A diameter of the opening 24 in the washer 22 is less than a non-compressed diameter of the friction retainer 40. Therefore, in the pre-installed condition, the friction retainer 40 is positioned within the opening 24 in the washer 22 to place the friction retainer 40 in compression. This advantageously assists in installing the road grading pick 10 onto the adapter board 100. Because the frictional retainer 40 when non-compressed has a diameter greater than the bore in the adapter board 100 in which it will sit and because the frictional retainer 40 is very stiff and hard to compress, it is difficult to install in the adapter board 100. However, the compression of the friction retainer 40 by the washer 22 results in the diameter of the friction retainer 40 being smaller than the non-compressed diameter, preferably smaller than the diameter of the bore in the adapter board 100 in which it will sit. Thus, insertion of the road grading pick 10 into the bore in the adapter board 100 is facilitated by the pre-installation position of the washer 22.

Figure 12A:
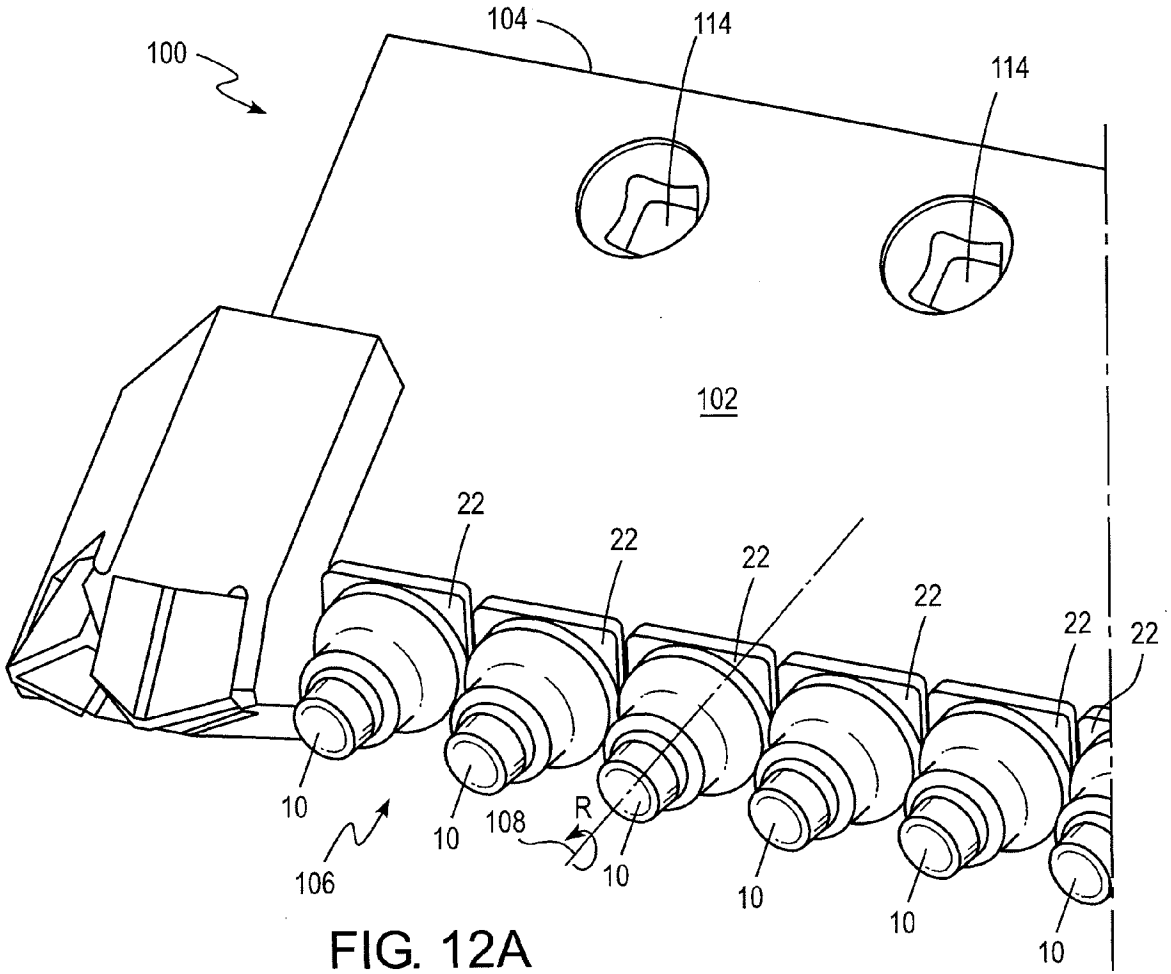
FIGS. 12A and 12B are each a perspective view of an exemplary embodiment of a road grading pick installed on an adapter board for a moldboard of a piece of road grading equipment.
Figure 12B:
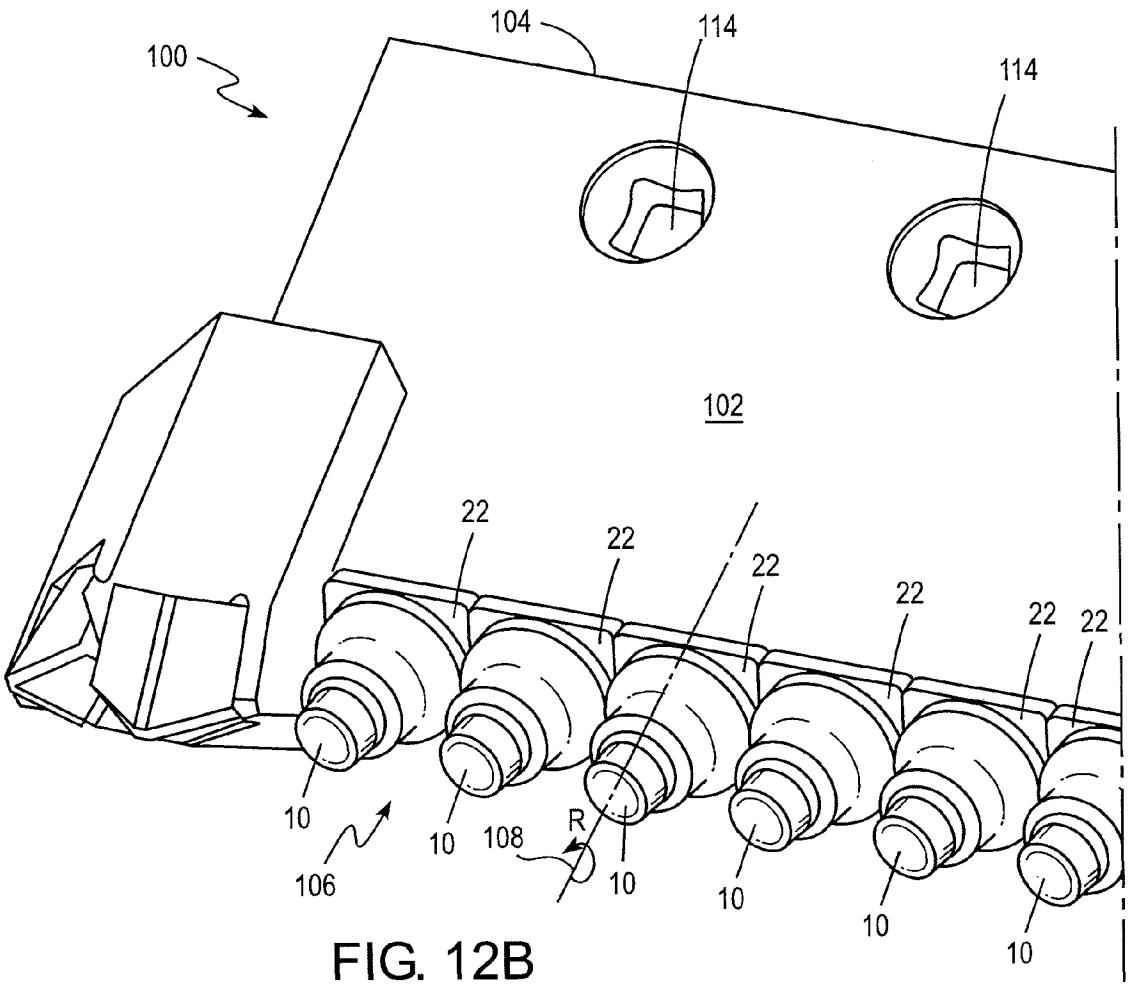

FIGS. 12A and 12B each show a partial view of an adapter board 100 for mounting on a moldboard of a road grading apparatus. In the exemplary embodiments shown, the adapter board 100 comprises an elongated planar housing 102 having a first edge 104 for mounting to the moldboard. A second edge 106 opposes the first edge 104 and a plurality of road grading picks 10 are mounted on the second edge 106. The plurality of road grading picks 10 can be any of the exemplary embodiments shown and disclosed herein. For example, the plurality of road grading picks include a cutting head with a cutting tip at a front end, a shank at a rear end, a shoulder at a transition between the cutting head and the shank, the shoulder including a rearward-facing surface, a friction retainer positioned about at least a portion of the shank, and a polygonal-shaped washer 22 including an opening in a body extending from a first surface to a second surface. Alternatively, an oval-shaped washer can be used or a combination of polygonal-shaped and oval-shaped washers can be used.

The plurality of road grading picks are rotatably mounted in a bore in the second edge by the friction retainer. The shank is positioned in the opening of the washer with the first surface of the washer contacting the rearward-facing surface of the shoulder and the second surface of the washer contacting the second edge of the adapter board. In the installed position, the washer has been moved toward the cutting head and the friction retainer is no longer constrained within the opening of the washer. Rather, the friction retainer is now in friction contact with the inner surfaces of the bore in the second edge. However, in this installed position, the shank of the road grading pick is rotatable R about its axis 108. A rear shoulder 110 is sized so that it does not pass through the installed friction retainer and out of the bore.

As described herein, rotation of the washer 22 is inhibited such that rotation of the washer 22 about the axis 108 of the road grading pick 10 can only progress so far, i.e., so many degrees, before some part of the edge 30 contacts the edge 30 of a washer 22 of an adjacent road grading pick 10 or other stop surface. Where the distance between washers 22 of adjacent road grading picks 10 is substantially non-existent, the washers 22 will only minimally rotate or rotate not at all. In this instance, the contact between the edges 30 or other stop is a face or plane contact, e.g., edge 30 contacting adjacent edge 30, face 32 contacting adjacent face 32, or edge 30 or face 32 contacting adjacent stop. Of course, manufacturing tolerances may prevent such face or plane contact from occurring while still limiting rotation to less than 10°, alternatively less than 5°, alternatively less than 2°.

As the distance between washers 22 of adjacent road grading picks 10 increases, the washers 22 will be free to rotate to a greater extent. In this instance, the contact between the edges 30 of adjacent washers is a line contact or a point contact (depending on the thickness of the face 32). For example, where the washer rotates no more than one face, position-wise, before some contact between cooperating washers occurs, then rotation of the washer greater than N degrees, $$N = \frac{360}{n},$$

is prevented, where n is the number of sides of the polygonal-shaped washer. Alternatively, for an outer peripheral edge with one or more edges 30 or faces 32 being at a larger radial distance from the central axis 108, rotation is prevented that is greater than or equal to 360°, i.e., the washer does not make a complete rotation. In exemplary embodiments, N is 120° or less, alternatively, 90° or less, 60° or less, 45° or less, 30° or less, 20° or less, or in a range between any of these rotation angles. Also alternatively, for an oval shaped washer without distinct separate edges the washers rotate no more than 180°, alternatively, 120° or less, alternatively, 90° or less, 60° or less, 45° or less, 30° or less, 20° or less, or in a range between any of these rotation angles Of course, the edges 30 or faces 32 do not have to be straight or planar, but may be concave, convex, angled, partial, continuous or broken, or any other shape, as in the Reuleaux polygon example, so long as there is a portion of the edge 30 or face 32 that cooperates with an edge or face of the adjacent washer 22 and that the washers 22 do not make a complete 360° rotation. Also, although two adjacent washers in some instances, e.g., where the separation between adjacent washers is large, may theoretically be able to rotate in opposite directions and thereby rotate a full 360°, such full rotation in practice is prevented by a reduced separation distance between adjacent washers, an interlocking action of the numerous numbers of washers that would have to act together to allow such motion, or a combination of such features.

Exemplary embodiments of a road grading pick can be incorporated into a road grading apparatus. For example, a road grading apparatus can comprise a moldboard and an adapter board 100 mounted thereto. The adaptor board 100 includes exemplary embodiments of the disclosed road grading pick 10. A number of such road grading picks 10 are mounted on the second edge 106 of the adapter board 100. The adapter board 100 is mounted to the moldboard (not shown) by connecting the first edge 104 of the elongated planar housing 102 of the adapter board 100 to the moldboard. For example and as shown more clearly in FIG. 13, a groove 112 in the housing 102 can be placed over a leading edge of the moldboard and then secured with connectors (not shown) placed through openings 114.

Exemplary embodiments of the road grading pick 10 have a cutting tip 14 with a composition that includes a hard material. A suitable hard material is cemented tungsten carbide. Further, exemplary embodiments of the road grading pick 10 have a cutting tip 14 with any suitable tip geometry. In one example, the tip geometry includes a blunt forward surface portion 120 or has both a blunt forward surface portion 120 with a flat region 122 oriented perpendicularly to the axis 108 of the road grading pick 10. Optionally, other geometric features as disclosed U.S. Pat. No. 5,054,217, the entire disclosure of which is incorporated herein by reference, can be substitute for or incorporated with the blunt forward surface portion.

The exemplary embodiments disclosed herein provide several advantageous properties when installed, for example, on an adapter board of a road grading apparatus. For example, adding a washer to a road grading pick may enhance rotation of the installed road grading pick. Rotation of the road grading pick contributes to self-sharpening of the road grading pick during use. Also for example, by designing a washer with a polygonal shape or oval shape and positioning adjacent road grading picks appropriately, washer rotation is limited or eliminated. For example, the road grading pick can be positioned such that a first washer is situated so closely together to an adjacent washer or other stop surface that the edges abut one another, thereby preventing rotation. Alternatively, the road grading pick can be positioned such that a washer is situated with a circumscribing circle or oval overlapping an adjacent washer, circumscribing circle or oval, or other stop surface. Because the washer cannot rotate or is limited in the amount of rotation, grinding action of the fines is likewise limited or eliminated, with attendant decrease in wear of both the road grading pick and the adapter board. As another example, by designing a washer with a polygonal-shaped edge and positioning adjacent road grading pick appropriately, the surface of the adapter board can be protected. As the washers of adjacent road grading picks move closer to each other, up to and including abutting each other, more and more of the underlying surface of the adapter board is shielded from direct contact with wear causing substances, such as debris and fines. Thus, the washers provide a type of sacrificial coating or armor for the underlying mounting surface, a type of protection that is renewed each time a worn road grading pick is exchanged for a new road grading pick.

Although described in connection with preferred embodiments thereof, it will be appreciated by those skilled in the art that additions, deletions, modifications, and substitutions not specifically described may be made without department from the spirit and scope of the invention as defined in the appended claims.

The disclosures in U.S. provisional patent application No. 61/054,175, from which this application claims priority, are incorporated herein by reference.

The invention claimed is:

1. An adapter board for a moldboard of a piece of road grading equipment, the adapter board comprising:

an elongated planar housing including a first edge for mounting to the moldboard; and a plurality of road grading picks mounted on a second edge of the housing, the second edge opposing the first edge, wherein the plurality of road grading picks include a cutting head with a cutting tip at a front end, a shank at a rear end, a shoulder at a transition between the cutting head and the shank, the shoulder including a rearward-facing surface, a friction retainer positioned about at least a portion of the shank, and a washer including an opening in a body extending from a first surface to a second surface, wherein the plurality of road grading picks are rotatably mounted in a bore in the second edge by the friction retainer, wherein the shank is positioned in the opening of the washer with the first surface of the washer contacting the rearward-facing surface of the shoulder and the second surface of the washer contacting the second edge of the adapter board, wherein the opening of the washer is chamfered or countersunk from the first surface and includes an extruded cone projecting from a plane of the second surface, wherein the extruded cone projecting from the plane of the second surface of the washer mates in the bore in the second edge of the adapter board, and wherein edges of washers of adjacent road grading picks contact each other to prevent rotation of the washer greater than 180 degrees.

2. The adapter board of claim 1, wherein the edges of contacting washers abut each along an entire length of said edges.

3. The adapter board according to claim 2, wherein at least one washer is polygonal-shaped, and wherein adjacent road grading picks are spaced one from the other to prevent rotation of the washer greater than N degrees, $$N = \frac{360}{n},$$

where n is the number of edges of the polygonal-shaped washer and $n \geqq 0.3$.

4. The adapter board according to claim 2, wherein at least one washer is oval-shaped, and wherein adjacent road grading picks are spaced one from the other to prevent rotation of the washer greater than 180 degrees.

5. The adapter board according to claim 1, wherein at least one washer is polygonal-shaped, and wherein adjacent road grading picks are spaced one from the other to prevent rotation of the washer greater than N degrees, $$N = \frac{360}{n},$$

where n is the number of edges of the polygonal-shaped washer and $n \geqq 0.3$.

6. The adapter board according to claim 1, wherein at least one washer is oval-shaped, and wherein adjacent road grading picks are spaced one from the other to prevent rotation of the washer greater than 180 degrees.

7. The adapter board according to claim 6, wherein the edge of the washer has a thickness, wherein the thickness of the edge defines a face, and wherein the face of an edge on a first washer contacts the face of an edge on a second washer.

8. The adapter board according to claim 1, wherein the edge of the washer has a thickness, wherein the thickness of the edge defines a face, and wherein the face of an edge on a first washer contacts the face of an edge on a second washer.

9. The adapter board of claim 8, wherein the face of the edge on the first washer makes line contact with the face of the edge on the second washer.

10. The adapter board of claim 8, wherein the face of the edge on the first washer makes plane contact with the face of the edge on the second washer.

11. The adapter board as in claim 1, wherein the cutting tip has a composition including a hard material and has a blunt forward surface.

12. The adapter board of claim 11, wherein the hard material is cemented tungsten carbide.

13. A road grading apparatus, comprising:

a moldboard; and the adapter board as in claim 1, wherein the adapter board is mounted on the moldboard.

* * * * *